US008814313B2

(12) United States Patent
Leighton et al.

(10) Patent No.: US 8,814,313 B2
(45) Date of Patent: Aug. 26, 2014

(54) SYSTEM AND METHOD FOR ADJUSTING THE TENSION OF A CONTINUOUS WEB OF RECORDING MEDIA IN A PRINTER

(75) Inventors: Roger G. Leighton, Hilton, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 165 days.

(21) Appl. No.: 13/554,284

(22) Filed: Jul. 20, 2012

(65) Prior Publication Data

US 2014/0023421 A1 Jan. 23, 2014

(51) Int. Cl.
*B41J 29/38* (2006.01)
*B41J 2/01* (2006.01)

(52) U.S. Cl.
USPC ..... 347/16; 347/101; 347/104

(58) Field of Classification Search
None
See application file for complete search history.

(56) References Cited

U.S. PATENT DOCUMENTS

| | | | |
|---|---|---|---|
| 7,665,817 | B2 | 2/2010 | Folkins |
| 7,878,617 | B2 | 2/2011 | Mizes et al. |
| 2011/0061552 | A1 | 3/2011 | Eun et al. |

FOREIGN PATENT DOCUMENTS

WO WO 2010/120299 A1 * 10/2010 ..... B41J 15/00

* cited by examiner

*Primary Examiner* — Geoffrey Mruk
(74) *Attorney, Agent, or Firm* — Maginot, Moore & Beck, LLP

(57) ABSTRACT

A method for adjusting the tension of a continuous web of recording media in a printing system. The method includes identifying a tension in the continuous web and adjusting the tension in response to the amount of ink being deposited on the recording media. An offset tension value is determined, stored in memory, and used by a controller to adjust the velocity or tension of the continuous web moving through the printing system to improve the printing of images.

11 Claims, 4 Drawing Sheets

SYSTEM AND METHOD FOR ADJUSTING THE TENSION OF A CONTINUOUS WEB OF RECORDING MEDIA IN A PRINTER

TECHNICAL FIELD

This disclosure relates generally to a printing system and to a method of adjusting the tension of a continuous web of recording media in the printing system, and more particularly to adjusting the tension based on the amount of ink being deposited on the continuous web of recording media.

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets solidify.

The media used in both direct and offset printers can be in web form. In a web printer, a continuous supply of media, typically provided in a media roll, is entrained onto rolls that are driven by motors. The motors and rolls pull the web from the supply roll through the printer to a take-up roll. The rollers are arranged along a linear media path, and the media web moves through the printer along the media path. As the media web passes through a print zone opposite the printhead or heads of the printer, the printheads eject ink onto the web. Along the feed path, tension bars or other rolls remove slack from the web so the web remains taut without breaking.

Existing web printing systems use a registration control method to control the timing of the ink ejections onto the web as the web passes the printheads. One known registration control method that can be used to operate the printheads is the single reflex method. In the single reflex method, the rotation of a single roller at or near a printhead is monitored by an encoder. The encoder can be a mechanical or electronic device that measures the angular velocity of the roller and generates a signal corresponding to the angular velocity of the roll. The angular velocity signal is processed by a controller executing programmed instructions for implementing the single reflex method to calculate the linear velocity of the web. The controller can adjust the linear web velocity calculation by using tension measurement signals generated by one or more load cells that measure the tension on the web near the roll. The controller implementing the single reflex method is configured with input/output circuitry, memory, programmed instructions, and other electronic components to calculate the linear web velocity and to generate the firing signals for the printheads in the marking stations.

Another existing registration control method that can be used to operate the printheads in a web printing system is the double reflex method. In the double reflex method, each encoder in a pair of encoders monitors one of two different rolls. One roller is positioned on the media path prior to the web reaching the printheads and the other roller is positioned on the media path after the media web passes the printheads. The angular velocity signals generated by the two encoders for the two rolls are processed by a controller executing programmed instructions for implementing the double reflex method to calculate the linear velocity of the web at each roller and then to interpolate the linear velocity of the web at each of the printheads. These additional calculations enable better timing of the firing signals for the printheads in the marking stations and, consequently, improved registration of the images printed by the marking stations in the printing system. A double reflex printing system is disclosed in issued U.S. Pat. No. 7,665,817.

While control of the rotational speed of rollers can be critical for the proper registration of images, other factors besides web transport can affect image registration. For instance, the material properties of the recording media can affect registration of images. If the continuous web slips when engaged with one or more rolls in the media path, the position of the media web with respect to the printheads is affected and errors in images formed on the media web can occur. If the web either stretches of shrinks during imaging, misregistration of images can also occur. Consequently, improvements to a printing system and to printing images by taking into account the material properties of the media web being imaged are desirable.

SUMMARY

A method of adjusting the operation of a printing system by taking into account the material properties of the recording media has been developed. The method of adjusting the operation of a printing system depositing ink on a continuous web of recording media moving along a web path includes identifying Young's modulus for the recording media. The method includes identifying a first tension of the continuous web of recording media moving along the web path, detecting an amount of ink to be deposited on the continuous web of recording media greater than a first predetermined amount of ink, and adjusting the first tension of the continuous web of recording media to a second tension in response to the detection of the amount of ink greater than the first predetermined amount of ink.

A method of adjusting the tension of a continuous web of recording media moving along a web path in a printing system depositing ink to form images on the continuous web includes identifying a first tension of the continuous web of recording media moving along the web path, detecting an amount of ink to be deposited on the continuous web of recording media, selecting a tension offset value from a plurality of tension offset values in response to the detection of the amount of ink, and adjusting the identified first tension of the recording media with the selected tension offset value.

A printing system configured to adjust a tension in a continuous web of recording media in response to changes in the material properties of the recording media has been developed. The printing system configured to deposit ink on a continuous web of recording media in response to image data includes a roller, a memory, and a controller. The roller is configured to move the continuous web through the printing system at a tension and to adjust the tension of the continuous web during movement through the printing system. The memory includes a plurality of memory locations, wherein each memory location includes a stored tension offset value. The controller is operatively connected to the roller and to the memory. The controller includes an image analyzer to detect an amount of ink to be deposited on the continuous web in response to the image data. The controller is also configured to select one of the stored tension offset values in response to the detected amount of ink and to modify operation of the roller in response to the selected stored tension offset value to adjust the tension of the continuous web.

DETAILED DESCRIPTION

Figure 1:
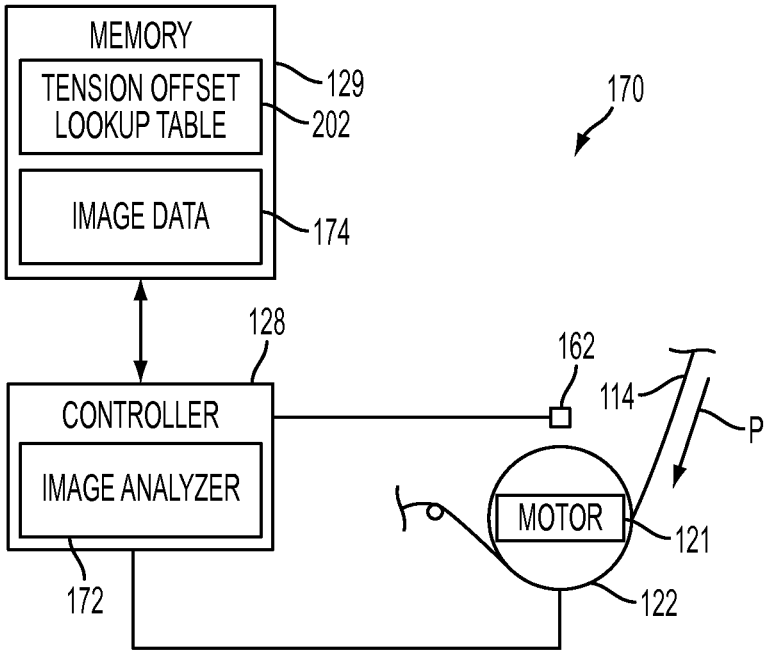
FIG. 1 is schematic diagram of one embodiment of a portion of a printing system having a tension control system for adjusting the tension of a continuous web of print media.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web traverses through a printer during the printing process. Examples of media webs include rolls of paper or polymeric materials used in printing. The media web has two sides forming surfaces that can each receive images during printing. Each surface of the media web is made up of a grid-like pattern of potential drop locations, sometimes referred to as pixels.

Figure 4:
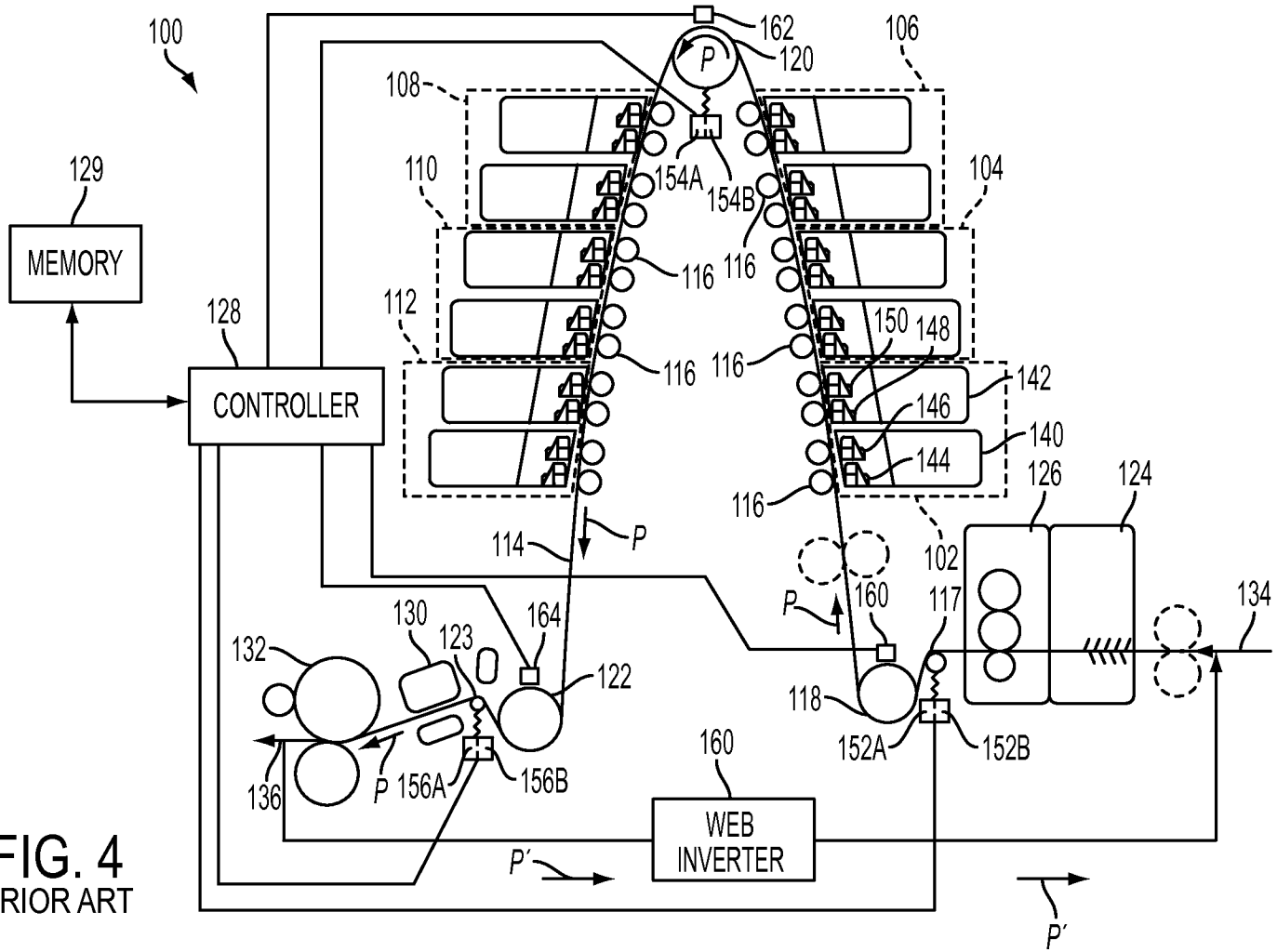
FIG. 4 PRIOR ART
FIG. 4 is a schematic diagram of a prior art duplex continuous web printing system.

As used herein, the term "capstan roll" refers to a cylindrical member configured to have continuous contact with the media web moving over a curved portion of the member, and to rotate in accordance with a linear motion of the continuous media web. The capstan drum or roll is used as a drive point using the wrap angle and friction to grip the web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member. FIG. 4 depicts a prior art inkjet printer 100 having elements pertinent to the present disclosure. In the embodiment shown, the printer 100 implements a solid ink print process for printing onto a continuous media web. Although the media web tension control method and system are described below with reference to the printer 100 depicted in FIG. 4, the subject method and apparatus disclosed herein can be used in any printer, such as a cartridge inkjet printer, which uses serially arranged printheads to eject ink onto a web image substrate.

FIG. 4 depicts a continuous web printer system 100 that includes six print modules 102, 104, 106, 108, 110, and 112; a controller 128, a memory 129, guide rolls 116, pre-heater roller 118, apex roller 120, leveler roller 122, tension sensors 152A-152B, 154A-154B, and 156A-156B; and encoders 160, 162, and 164. The print modules 102, 104, 106, 108, 110, and 112 are positioned sequentially along a media path P and form a print zone for forming images on a print medium 114 as the print medium 114 travels past the print modules. Each print module 102, 104, 106, 108, 110, and 112 in this embodiment provides an ink of a different color. In all other respects, the print modules 102, 104, 106, 108, 110, and 112 are substantially identical. The media web travels through the media path P guided by rolls 116, pre-heater roller 118, apex roller 120, and leveler roller 122. In FIG. 4, the apex roller 120 is an "idler" roll, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader 132 are located at the opposite end 136 of the media path P.

The embodiment of FIG. 4 includes web inverter 160 that is configured to route the media web 114 from the end 136 of media path P to the beginning 134 of the media path through an inverter path P'. The web inverter flips the media web and the inverter path P' returns the flipped web to the inlet 134 to enable duplex printing where the print modules 102-112 form ink images on a second side of the media web after forming images on the first side. In this operating mode, a first section of the media web moves through the media path P in tandem with a second section of the media web, with the first section receiving ink images on a first side of the media web and the second section receiving ink images on the second side. This configuration can be referred to as a "mobius" configuration. Each of the print modules 102-112 is configured to eject ink drops onto both sections of the media web. Each of the rolls 116, 118, 120, and 122 also engage both the first and second sections of the media web. After the second side of the media web 114 is imaged, the media web 114 passes the end of the media path 136.

As illustrated in FIG. 4, print module 102 includes two print submodules 140 and 142. Print submodule 140 includes two print units 144 and 146. The print units 144 and 146 each include an array of printheads that are arranged in a staggered configuration across the width of both the first section of web media and second section of web media. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path P at a predetermined resolution. In the example of FIG. 4, print submodule 140 is configured to emit ink drops in a twenty inch wide path that includes both the first and second sections of the media web at a resolution of 300 dots per inch. Ink ejectors in each printhead in print units 144 and 146 are configured to eject ink drops onto predetermined locations of both the first and second sections of media web 114. Print module 102 also includes submodule 142 that has the same configuration as submodule 140, but has a cross-process alignment that differs from submodule 140 by one-half of a pixel. This enables printing system 100 to print with twice the resolution as provided by a single print submodule. In the example of FIG.

4, submodules 140 and 142 enable the printing system 100 to emit ink drops with a resolution of 600 dots per inch. Each of the other print modules 104-112 can be similarly configured for duplex printing.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 102, 104, 106, 108, 110, and 112. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also store one or more values that identify the amount of tension for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rolls 120, 118, and 122. Typical embodiments of encoders 160, 162, and 164 include Hall effect sensors configured to generate signals in response to the movement of magnets operatively connected to the rolls and optical wheel encoders that generate signals in response to a periodic interruption to a light beam as a corresponding roller rotates. Controller 128 is operatively connected to the encoders 160, 162, and 164 to receive the angular velocity signals. Controller 128 includes hardware circuits or software routines configured to identify a linear velocity of each of the rolls 120, 118, and 122 using the generated signals and a known radius for each roll.

Tension sensors 152A-152B, 154A-154B, and 156A-156B are operatively connected to a guide roller 117, apex roller 120, and post-leveler roller 123, respectively. The guide roller 117 is positioned on the media path P prior to the preheater roller 118. The post-leveler roller 123 is positioned on the media path P after the leveler roller 122. Each tension sensor generates a signal corresponding to the tension force applied to the media web at the position of the corresponding roll. Each tension sensor can be a load cell configured to generate a signal that corresponds to the mechanical tension force between the media web 114 and the corresponding roll.

In the embodiment of FIG. 4 where two sections of the media web 114 engage each roller in tandem, each of the tension sensors are paired to identify the tension on each section of the media web 114. In embodiments where one surface of the media web engages each roll, a single tension sensor can be used instead. Tension sensors 152A-152B generate signals corresponding to the tension on the media web 114 as the media web 114 enters the print zone passing print modules 102-112. Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

In operation, controller 128 measures the tension of the media web 114 at the guide roller 117, apex roller 120, and post-leveler roller 123. The velocity of the web 114 is measured on the preheat drum 118, apex roller 120, and leveler drum 122.

Referring now to FIG. 1, the prior art printer system 100 is modified to include a tension control system 170 and to operate a web tension control method as described herein. FIG. 1 illustrates a schematic diagram of one embodiment of a portion of the printer system 100 including the tension control system 170 for adjusting the tension of the continuous web of print media 114. The web tension control system 170 compensates for an increase in the tension of the continuous web 114 which can occur in response to the amount of ink being deposited on the continuous web during printing. As ink coverage increases from approximately 4% color ink and approximately 5% black ink up to a combined level of approximately 20% ink coverage or more, the accuracy of image registration in the process direction P can be affected. When the ink coverage increases above a predetermined level, an increase in tension at the apex roller 120 (See FIG. 4) can occur depending on the type of recording media and the amount of ink being deposited. The increased tension at the apex roller 120 can occur approximately three seconds from the start of the depositing of ink on the continuous web. The increase in tension causes a drop in the rotational speed of the leveler roller 122, the speed of which can be monitored, maintained, and adjusted by the controller 128 configured accordingly. In on embodiment, the rotational speed of the leveler roller can be modified by an algorithm configured to incorporate the double reflex printing method.

The controller 128 receives the encoder signals from the preheat roller 118, the apex roller 120, and the leveler roller 122. The controller 128 receives velocity signals from the rollers 118, 120, and 122. Tension signals representing the tension between the inlet 134 and the preheat roller 118 and between the preheat roller 118 and the leveler roller 122 are received by the controller 128. The controller 128 can apply the velocity signals and the tension signals in a feed forward tension control algorithm based upon the modulus, the web thickness and width, and the length of the web between drives. The known constants for each proportional and integral gain can be dynamically altered. In a feed forward control loop type algorithms, sufficient bandwidth should be provided to incorporate a management velocity trim control of approximately fifty (50) hertz. The machine natural frequency transfer function measures at 22 hertz (hz) which is the result of the motor stiffness, coupled roll inertias, and web stiffness. All of the system artifacts due to one revolution (also known as "once arounds") and other disturbances from the supply roll or mobius turnbar air dynamics are generally lower than 13 hz. Therefore, the current drive motors on the drums have sufficient bandwidth to control the disturbances. The change in web stiffness due to ink laydown is also a very low frequency effect.

An increase in tension resulting from the amount of ink deposited on the recording media can be determined by analyzing image data. To analyze the image data, the controller 128 includes an image analyzer 172 which can receive image data from an image data storage location 174 located in the memory 129. Other image data storage locations are also possible and other raster image processing systems can be applied. The image data can include a source file of image data having pixel information. The pixel information can include image data of 2 bits per pixel, for instance, which can be analyzed by the image analyzer 172 to determine the number of pixels of information being printed in an image and consequently the amount of ink to be deposited. While the image analyzer can provide a reasonably accurate determination of the amount of ink to be deposited based on an analysis of the image data, an estimate of the ink to be deposited can be sufficient to make a determination of an increase in tension. For instance, a rough pixel count can be made by the image analyzer 172 from ripped image data. The image that is created and ripped can be estimated for layer thickness and overall coverage.

In one embodiment, an image being printed initially at print module 102 takes approximately three seconds to fill a path on the continuous web between the print module 102 and the nip at the spreader roller 132. A two layer image is roughly twelve (12) micrometers (μm) thick and has sufficient heat to drive moisture from the web and sufficient mass to increase the tension on the continuous web. The typical primary color consists of 2 subtractive colors (magenta and cyan). The 5 to 6 μm dot of one color sits on top of a previously jetted color. Under these conditions, the continuous web can shrink an additional amount when compared to shrinkage experienced by the web under typical conditions of ink coverage of approximately 4% color ink and approximately 5% black ink. The combined forces resulting from the additional ink can shrink the web an additional 1% which can cause a process direction error of up to two hundred (200) μm. Such a process direction error can result in a misregistration of images and consequently can provide poor or unacceptable images.

A normal low coverage image, such as text and data for instance, can produce a uniform shrinkage in the continuous web for an entire print job. When a full width two layer image on one side moves from the first printhead module 102 to the spreader 132, a change in velocity and tension can occur. The continuous web is essentially clamped between the preheater roller 118 and the nip of the spreader roller 132. Because the continuous web is heated, moisture is driven from the web roughly 1 to 1.5% is removed through the thermal processes. In addition, ink can shrink by approximately 17% as the ink passes from the liquid state to the solid state resulting in shrinkage of the web. These two factors can generate a strain in the continuous web resulting from exerted the loss of moisture and the ink shrinkage. The increase in strain can be approximated by the following equation:

$$\sigma = T/t$$

$$\varepsilon = \frac{\sigma}{E} = \frac{T}{AE}$$

where $\epsilon$=0.0016 strain, T represents tension in pounds per linear inch (pli), t=thickness, $\sigma$ represents plane stress, and E represents the modulus of the media. The thickness is a composite thickness of paper and ink. E is composite modulus with moisture loss.

Tension strain prior to an image filling the continuous web generates approximately 5.43 millimeters (mm) of stretch in the web over a length of the continuous web of 3.44 meters, strain=0.0016, which corresponds in one embodiment to the distance between the pre-heater roller 118 and the leveler roller 122. When the image fills the web path, the strain rises to approximately $\epsilon$=0.001 and the shrinkage decreases the web length by $\delta$=5.77 tbd mm. The delta change or difference in strain is approximately 0.01% but results in a smaller length in the process direction of approximately 344 μm. However, in a feed forward control loop type algorithm, such as a double reflex printing algorithm, the rotational velocity of the leveler roller 122 is reduced to restore the tension of the continuous web to an original tension setpoint. The change in velocity, however, can affect image registration in the process direction P. The speed of the continuous web is subsequently reduced by approximately 0.2 meters per second or 0.01% and adds to the registration error. If the total ink coverage is greater than approximately 20%, then a tension offset value of approximately 1.5 to 2.0% can be applied. The tension in the web is reduced to compensate for the increase in the tension of the web resulting from the ink. The tension offset can be used to adjust and maintain the speed of the leveler roller 122 during the print job to reduce or eliminate registration errors resulting from the deposited ink.

Figure 2:
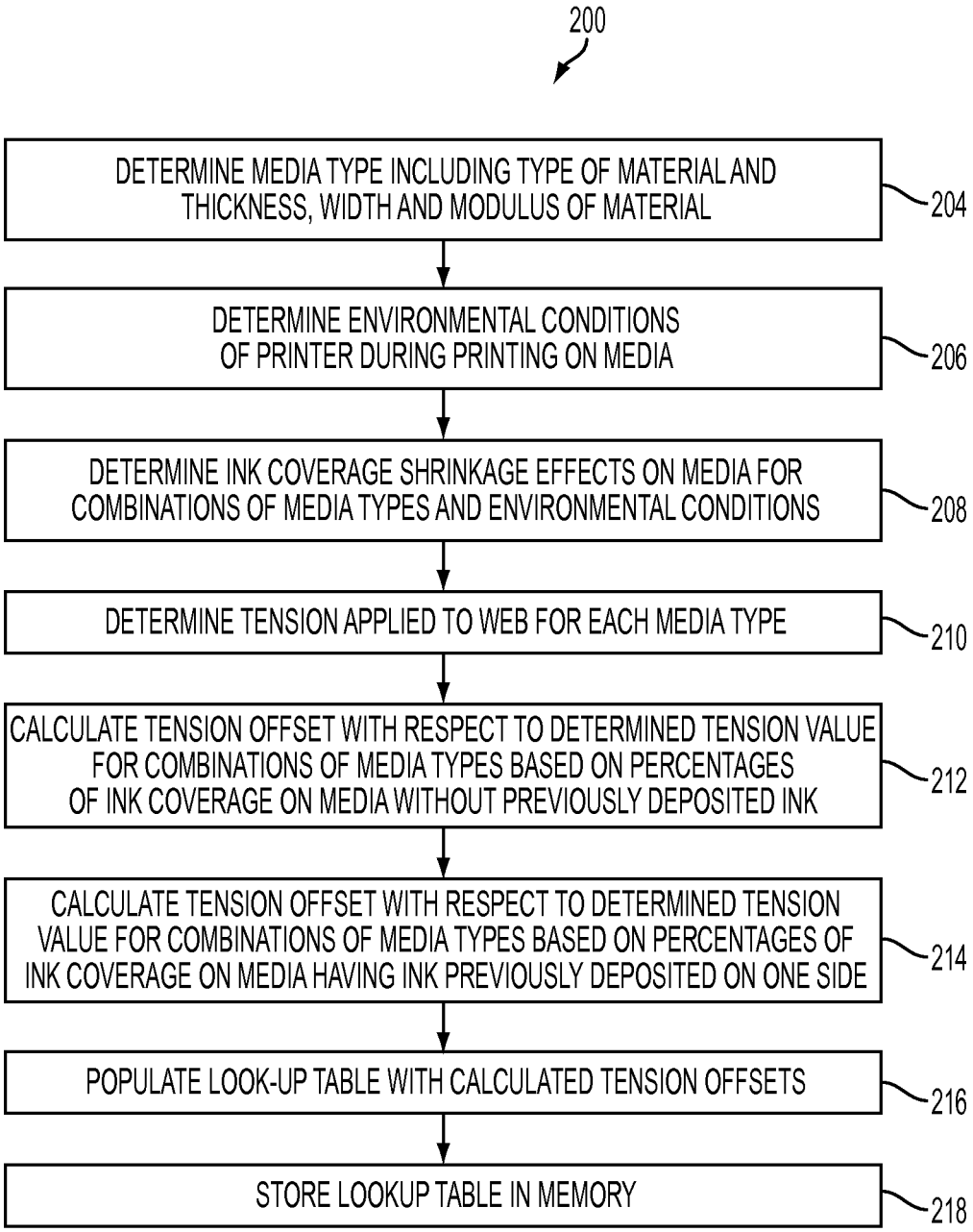
FIG. 2 is a flow diagram of a method for providing a plurality of tension offsets for adjusting the tension of a continuous web of print media in a printing system.

FIG. 2 is a flow diagram 200 of a method for providing a plurality of tension offsets, or tension offset values, for adjusting the tension of a continuous web of print media in a printing system. Because a single printing system can print images on different types of web media, a determination of the type of media and effects of ink deposited on the media can be made. This information can be used to generate the plurality of tension offset values, each of which is configured to represent the particular type of media being imaged and a shrinkage experienced by that media during printing. The plurality of tension offset values are stored in one or more lookup tables stored in a tension offset lookup table 202 in the memory 129 of FIG. 1. The memory 129 can be a non-volatile memory. Other storage locations are also possible.

The determination of the media type includes determining the type of material, the thickness of the material and the modulus of the material, which is a measure of the stiffness of an elastic material (block 204). The type of material can include a wide variety of materials, including paper, textiles, and polymerics each of this can react differently to the application of ink to one or both of the surfaces of the media in simplex or duplex printing. A determination of the environmental conditions experienced by the web material can also be made since environmental conditions within a printer as well as outside a printer can affect the characteristics of the material, including for instance humidity content. (block 206). While the determination of environmental conditions affecting the material can be used, this determination is not critical and can be eliminated from a determination of the tension offsets for each type of material.

Once the types of media and the effects of environmental conditions, if any, on media types has been made, a determination of the shrinkage effects of deposited ink for each media type can be made (block 208). Because heated ink can generate different amounts of shrinkage in different types of media, a different tension offset can be determined for each media type. Different types of inks can also provide different amounts of shrinkage as well. In fact, a single media type can shrink a different amount for each different type of ink. Consequently, when determining ink coverage shrinkage effects, the types of media as well as the types of inks can be examined.

Each printing system can control the transport speed of the media web to a predetermined rate depending on the media type and an average of a typical amount of ink being deposited. For instance, in certain types of printing tasks such as transactional printing, the amount of ink to be deposited can be fairly consistent from one image to the next and from one printing task to the next. In view of this consistency, a determination of the tension applied to the continuous web for a typical amount of ink coverage is made (block 210).

The determined amount of tension for each media type made at block 210 can then be used to calculate a tension offset value for the combinations of media types based on the percentage of ink coverage deposited on the media without previously deposited ink, as found in simplex printing (block 212). When making this calculation, one or more tension offsets can be determined for each type of media to be imaged. For a first media type, for instance, a first tension offset can be determined for an ink coverage of between 15% and 20% and a second tension offset can be determined for an ink coverage of greater than 20%. Additional tension offsets can be determined for other media types at the same levels of ink coverage. While multiple tension offsets can be determined for a single media type and a single type of ink at different levels of ink coverage, one tension offset for a single media type and a single type of ink can be sufficient to provide for reasonably accurate registration depending on conditions.

Once the tension offsets have been made for media without ink, a second set of tension offsets can be made for media having ink previously deposited on one side and having ink being deposited on a second side as in duplex printing (block 214). As stated above, multiple tension offsets can be made for different amounts of ink coverage, but a single tension offset can be also be determined for ink coverage greater than a predetermined amount.

Once the tension offsets have been determined for simplex printing and for duplex printing, the tension offset values are used to populate the look-up table 202 for later access by the controller 128 (block 216). The look-up table is stored in the memory 129 (block 218).

Figure 3:
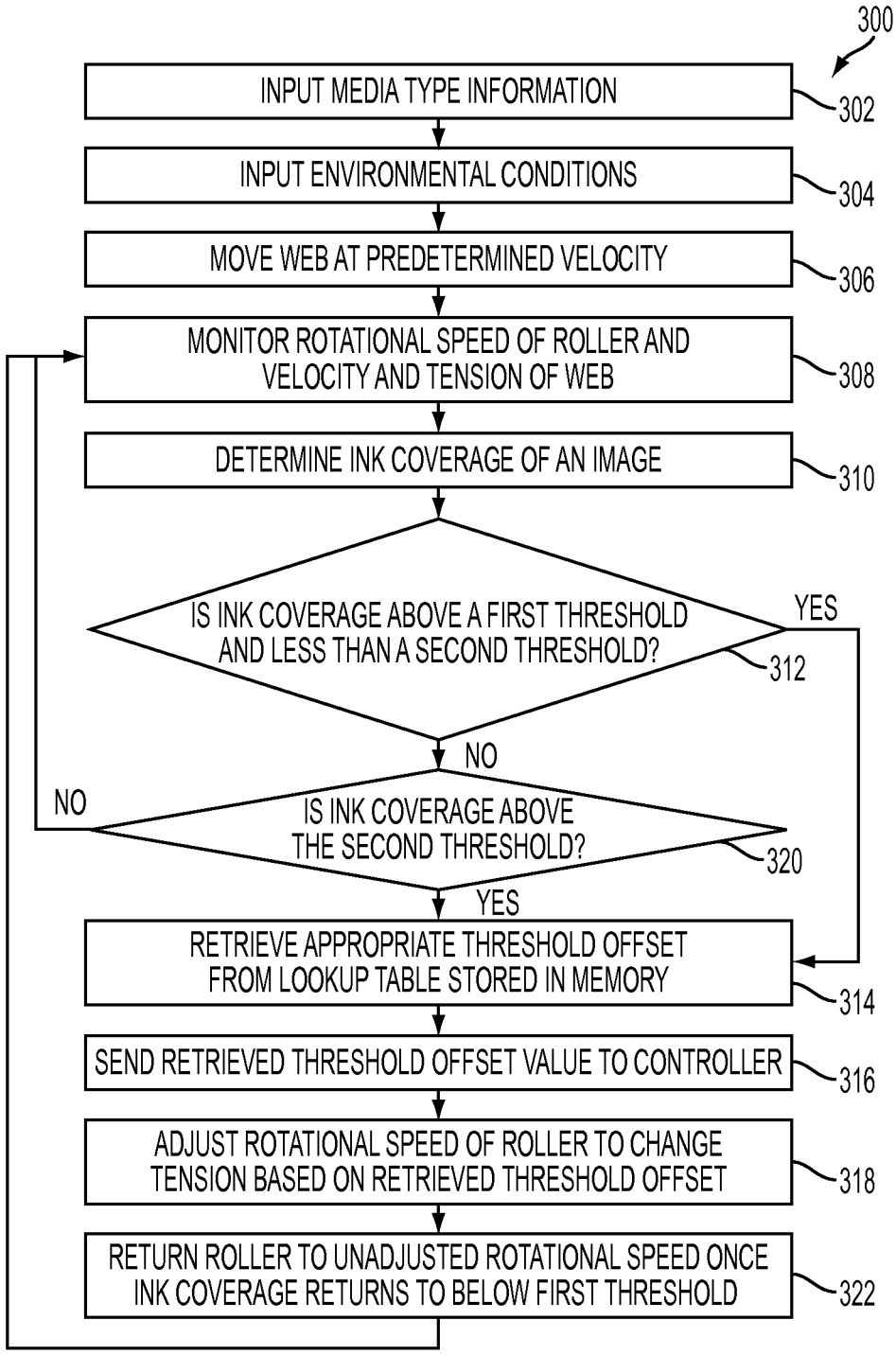
FIG. 3 is a flow diagram of a method of adjusting the tension of a continuous web of print media based on an amount of ink being deposited on the web.

FIG. 3 is a flow diagram 300 of a method of adjusting the tension of a continuous web of print media in a printing system based on the amount of ink being deposited on the web. The method of FIG. 3 can be implemented in the printing system of FIG. 4, as well as other printers and printing systems where the printing process can affect the amount of tension experienced by the media web.

The controller 128 is configured to access the tension offsets stored in lookup table 202. For the controller 128 to access the correct tension offsets, an operator or user can input the media type to the printing system (block 302). The input can be provided through a user interface. The printing system can also be configured to recognize the type of material being imaged. For instance, the printing system can recognize a machine readable code including linear bar codes and two-dimensional bar codes or paper parameters input by the operator. The printing system can also be programmed to recognize a single type of media web if the printing system is dedicated to a single type of media. If the tension offset values have been determined based on environmental conditions, the user or operator can input the proper environmental information to the printing system (block 304). The printing system can also include a temperature sensor, a humidity sensor, or both to provide the environmental conditions. Environmental conditions are not required, however, and this step can be eliminated.

Once the media type information and the environmental conditions have been input to the printing systems, the web moves at a predetermined velocity (block 306). After the media web reaches a steady state speed, printing can begin where ink is deposited on the moving web by the print module 102. The rotational speed of the leveler roller 122 is monitored by the encoder 162 and the tension of the media web is monitored by at least one of the tension sensors tension sensors 152A-152B, 154A-154B, and 156A-156B (block 308). While the velocity and tension of the web is being monitored, the controller 128 determines the amount of ink being deposited on the web as previously described (block 310). After determining the amount of ink coverage of an image, a determination is made regarding whether the ink coverage is above a first threshold but less than a second threshold (block 312). The first threshold is predetermined and can, for instance, be an ink coverage of twenty (20) percent. The second threshold is predetermined and can, for instance, be an ink coverage of fifty (50) percent. If the ink coverage is above the first threshold but less than the second threshold, the controller 128 retrieves the appropriate threshold offset value from the lookup table 202 (block 314). The retrieved threshold offset value is then used by the controller which is configured to calculate a new value of velocity using a velocity control algorithm (block 316). The new velocity value of the web is the original velocity value offset by the threshold offset value accessed by the controller 128 from the tension offset lookup table 202. The new velocity value is transmitted to a motor 121 of FIG. 1 which controls the rotational velocity of the leveler roller 122 (block 318).

If the ink coverage value is not between the first and second threshold values, then a determination is made whether the ink coverage is greater than the second threshold (block 320). If yes, the appropriate threshold offset value is retrieved from the lookup table (block 314). Once the rotational speed is adjusted to reflect the ink coverage above the second threshold value, the roller is returned to the unadjusted rotational speed (block 322). After returning to the unadjusted rotational speed, the speed of the roller and the velocity and tension of the web are monitored (block 308).

It will be appreciated that variants of the above-disclosed and other features and functions, or alternatives thereof, can be desirably combined into many other different systems, applications or methods. For instance the described embodiments and teachings can be applied to printing systems where a transition in ink coverage can occur from an area of high ink coverage to an area of low ink coverage, as well as a transition occurring from an area of low ink coverage to an area of high ink coverage. Various presently unforeseen or unanticipated alternatives, modifications, variations or improvements can be subsequently made by those skilled in the art that are also intended to be encompassed by the following claims.

What is claimed is:

1. A method of adjusting the operation of a printing system depositing ink on a continuous web of recording media moving along a web path comprising:

identifying with a sensor a first tension of the continuous web of recording media moving along the web path;

detecting with a controller that an amount of ink to be deposited on the continuous web of recording media is greater than a first predetermined amount of ink, the detection being made with reference to image data stored in a memory of the printing system; and adjusting with the controller the first tension of the continuous web of recording media to a second tension in response to the detection of the amount of ink being greater than the first predetermined amount of ink, the second tension compensating for shrinkage of the continuous web of print media resulting from the detection of the amount of ink being greater than the first predetermined amount of ink.

2. The method of claim 1 further comprising:

detecting with the controller that an amount of ink to be deposited on the continuous web of recording media is greater than a second predetermined amount of ink and adjusting with the controller the second tension to a third tension different than the second tension when the detected amount of ink is greater than the second predetermined amount of ink.

3. The method of claim 2 further comprising:

moving the recording media along the web path from a first roller to a second roller by modifying a rotational velocity of the second roller to adjust the first tension to the second tension.

4. The method of claim 3 further comprising:

adjusting the rotational velocity of the second roller to provide a tension different than the second tension.

5. The method of claim 4, the adjusting of the first tension further comprising:

adjusting the first tension with a tension offset value retrieved from the memory by the controller to provide the second tension, the tension offset value being determined based on a characteristic of the continuous web of recording media.

6. The method of claim 5, the adjusting of the first tension further comprising:

retrieving the tension offset value from a plurality of tension offset values, each tension offset value in the plurality of tension offset values is determined according to at least one characteristic of the continuous web of recording media.

7. The method of claim 6, the at least one characteristic of the continuous web of recording media further comprising a type of material for the continuous web, a thickness of material for the continuous web, or a modulus of material for the continuous web.

8. The method of claim 7 further comprising:

determining at least one of an environmental temperature condition and a process drum temperature condition of the printing system.

9. The method of claim 8, the adjusting of the first tension further comprising:

adjusting the first tension based on at least one of the determined environmental temperature condition and the process drum temperature condition.

10. The method of claim 9, the determination of the environmental condition of the printing system further comprising:

determining one of a temperature and a humidity associated with the printing system.

11. A method of adjusting a tension of a continuous web of recording media moving along a web path in a printing system comprising:

identifying with a sensor a first tension of the continuous web of recording media moving along the web path;

detecting with a controller an amount of ink to be deposited on the continuous web of recording media, the controller detecting the amount of ink to be deposited with reference to image data stored in a memory operatively connected to the controller;

selecting with the controller a tension offset value from a plurality of tension offset values stored in the memory the selection being made with reference to a type of material for the continuous web, a thickness of material for the continuous web, a modulus of material for the continuous web, and one of a process drum temperature and a humidity of the material for the continuous web in response to the detected amount of ink being greater than a predetermined amount of ink; and adjusting with the controller the identified first tension of the recording media with the selected tension offset value.

* * * * *